US010381756B2

(12) United States Patent
Ju et al.

(10) Patent No.: US 10,381,756 B2
(45) Date of Patent: Aug. 13, 2019

(54) ELECTRICAL CONNECTOR

(71) Applicant: LOTES CO., LTD, Keelung (TW)

(72) Inventors: Ted Ju, Keelung (TW); Zuo Feng Jin, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/032,439

(22) Filed: Jul. 11, 2018

(65) Prior Publication Data

US 2019/0067845 A1 Feb. 28, 2019

(30) Foreign Application Priority Data

Aug. 22, 2017 (CN) ..... 2017 1 0724581

(51) Int. Cl.

| | |
|---|---|
| ***H01R 12/57*** | (2011.01) |
| ***H01R 13/6585*** | (2011.01) |
| ***H01R 13/24*** | (2006.01) |
| ***H01R 12/70*** | (2011.01) |

(52) U.S. Cl.

CPC ..... *H01R 12/57* (2013.01); *H01R 12/7082* (2013.01); *H01R 13/2407* (2013.01); *H01R 13/2442* (2013.01); *H01R 13/6585* (2013.01)

(58) Field of Classification Search

CPC ..... H01R 13/65807; H01R 13/6585; H01R 13/6588; H01R 23/688; H01R 23/7073; H01R 13/2407; H01R 13/2442; H01R 12/57; H01R 12/7082

USPC ..... 439/607.05, 607.08–607.11

See application file for complete search history.

(56) References Cited

U.S. PATENT DOCUMENTS

| | | | | |
|---|---|---|---|---|
| 6,435,913 | B1 * | 8/2002 | Billman | H01R 13/6585 439/607.1 |
| 9,356,401 | B1 * | 5/2016 | Horning | H01R 13/6585 |
| 9,837,737 | B1 * | 12/2017 | Huang | H01R 12/7076 |
| 2005/0042925 | A1 * | 2/2005 | Dattilo | H01R 43/205 439/607.01 |
| 2014/0080327 | A1 * | 3/2014 | Hwang | H01R 13/6585 439/65 |

(Continued)

FOREIGN PATENT DOCUMENTS

| | | |
|---|---|---|
| CN | 202034628 U | 11/2011 |
| CN | 203135040 U | 8/2013 |
| CN | 103855540 A | 6/2014 |

*Primary Examiner* — Gary F Paumen

(74) *Attorney, Agent, or Firm* — Locke Lord LLP; Tim Tingkang Xia, Esq.

(57) ABSTRACT

An electrical connector for electrically connecting a chip module to a circuit board includes: a body; multiple terminals, respectively accommodated in the body, where each terminal has one end configured to be electrically connected to the chip module and another end configured to be electrically connected to the circuit board, and two adjacent terminals form a differential signal pair; and multiple shielding members, where each shielding member is accommodated in the body and located at one side of a corresponding terminal, and each shielding member has one end configured to be electrically connected to the chip module and another end configured to be electrically connected to the circuit board. One terminal and one shielding member form a shielding assembly, and in each of two adjacent shielding assemblies, at least one shielding member is provided between two adjacent terminals.

20 Claims, 9 Drawing Sheets

(56) References Cited

U.S. PATENT DOCUMENTS

| | | | | |
|---|---|---|---|---|
| 2014/0154918 | A1* | 6/2014 | Chang | H01R 13/6585 439/607.01 |
| 2014/0335731 | A1* | 11/2014 | Chang | H01R 13/6466 439/620.13 |
| 2014/0349518 | A1* | 11/2014 | Chang | H01R 13/6585 439/607.01 |
| 2015/0031238 | A1* | 1/2015 | Davis | H01R 23/688 439/607.05 |
| 2016/0036165 | A1* | 2/2016 | Phillips | H01R 13/6461 439/607.05 |
| 2018/0123270 | A1* | 5/2018 | Huang | H01R 12/52 |
| 2018/0219329 | A1* | 8/2018 | Morgan | H01R 13/6585 |
| 2018/0366881 | A1* | 12/2018 | Chang | H01R 13/6588 |

* cited by examiner

100

100

A-A

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201710724581.7 filed in China on Aug. 22, 2017. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and more particularly to an electrical connector with a shielding function.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

As the requirement on the data transmission capability of an electrical connector increases, the number of signal terminals must be greatly increased. As a result, the arrangement of the signal terminals on an insulating body becomes denser, such that crosstalk between the adjacent signal terminals may easily occur, thereby destroying the integrity of signals.

In order to increase the stability of signal transmission, the Chinese Patent No. CN201120023097.X, recites an electrical connector, which includes: an insulating body, where the insulating body is provided with multiple accommodating holes running vertically therethrough, and a bottom surface of the insulating body is provided with multiple shielding holes which are respectively located around the accommodating holes. Multiple signal terminals are respectively provided in the accommodating holes. Multiple shielding bodies are respectively accommodated in the shielding holes. A grounding member is conductively connected to the shielding bodies and extends out of the insulating body for grounding, thus decreasing the crosstalk between the signal terminals. However, the design requires the shielding bodies to be conductively connected by the grounding member that extends out of the insulating body for grounding, the forming process is complex, and due to the small size of the shielding bodies, the shielding effect is not ideal.

Therefore, a heretofore unaddressed need to design an improved electrical connector exists in the art to address the aforementioned deficiencies and inadequacies.

SUMMARY

In view of the deficiencies in the background, by arranging a shielding member at one side of each terminal and electrically connecting the shielding members with a chip module and a circuit board, an electrical connector of the present invention decreases signal interference between the terminals, realizing the stability of high-frequency high-speed transmission.

To achieve the foregoing objective, the invention adopts the following technical solutions.

An electrical connector, configured to electrically connect a chip module to a circuit board, includes: a body; a plurality of terminals, respectively accommodated in the body, wherein each of the terminals has one end configured to be electrically connected to the chip module and another end configured to be electrically connected to the circuit board, and two adjacent ones of the terminals form a differential signal pair; and a plurality of shielding members, wherein each of the shielding members is accommodated in the body and located at one side of a corresponding one of the terminals, and each of the shielding members has one end configured to be electrically connected to the chip module and another end configured to be electrically connected to the circuit board, wherein the terminals and the shielding members correspondingly form a plurality of shielding assemblies, such that each of the shielding assemblies comprises one of the terminals and one of the shielding members, and in each of two adjacent ones of the shielding assemblies, at least one of the shielding members is provided between two adjacent ones of the terminals in the two adjacent ones of the shielding assemblies.

In certain embodiments, each of the terminals has a main body portion, a first extending arm bends and extends from one end of the main body portion, the first extending arm is configured to abut the chip module, and another end of the main body portion is configured to abut the circuit board; and each of the shielding members has a shielding portion located at one side of the main body portion, a second extending arm extends from one end of the shielding portion, the second extending arm is configured to abut the chip module, and another end of the shielding portion is configured to abut the circuit board.

In certain embodiments, the one end of the main body portion bends upward and extends to form the first extending arm, the first extending arm has a first contact portion being curve shaped, the first contact portion is configured to upward abut the chip module, and the another end of the main body portion is configured to downward abut the circuit board; and the second extending arm extends obliquely upward from the one end of the shielding portion, the second extending arm has a second contact portion being curve shaped, the second contact portion is configured to upward abut the chip module, and the another end of the shielding portion is configured to downward abut the circuit board.

In certain embodiments, the second contact portion, the second extending arm and the shielding portion are on a same plane, a contact method between the second contact portion and the chip module is blanking surface contact, a contact method between the first contact portion and the chip module is plate surface contact, and the first contact portion and the second contact portion are on a same height level.

In certain embodiments, an angle $\alpha$ is formed between the first extending arm and the body, an angle b is formed between the second extending arm and the body, and the angle a is equal to the angle b.

In certain embodiments, when the chip module is pressed downward toward the body, the first extending arm and the second extending arm are deformed to be obliquely downward toward the body, and a force by the chip module pressing on the second extending arm is greater than a force by the chip module is pressed on the first extending arm.

In certain embodiments, the shielding portion comprises a first flat plate portion and a second flat plate portion, the second flat plate portion is formed by bending and extending from one side of the first flat plate portion, the first flat plate portion and the second flat plate portion are perpendicular to each other, and the first flat plate portion and the second flat plate portion are located at two sides of the main body portion.

In certain embodiments, the first flat plate portion has a first exposed portion exposed upward from the body, and the second flat plate portion has a second exposed portion exposed upward from the body.

In certain embodiments, one end of the first flat plate portion extends obliquely upward to form the second extending arm, the second extending arm and the first flat plate portion are on a same plane, the second extending arm is configured to abut the chip module, and another end of the first flat plate portion is configured to abut the circuit board.

In certain embodiments, a third flat plate portion bends and extends from the second flat plate portion, the third flat plate portion is parallel to the first flat plate portion, and the first flat plate portion, the second flat plate portion and the third flat plate portion are respectively located at three sides of the main body portion.

In certain embodiments, a fourth flat plate portion is formed by bending and extending from the third flat plate portion, the fourth flat plate portion is parallel to the second flat plate portion, and the first flat plate portion, the second flat plate portion, the third flat plate portion and the fourth flat plate portion are arranged around a periphery of the main body portion.

In certain embodiments, the shielding assemblies are staggeredly distributed on the body, and the shielding assemblies are respectively transversely arranged from left to right in a plurality of transverse rows, and are longitudinally arranged from front to rear in a plurality of longitudinal columns.

In certain embodiments, the two adjacent ones of the terminals forming the differential signal pair includes a first terminal and a second terminal along a longitudinal column direction, and the main body portion of the first terminal, the second flat plate portion of the first terminal, the main body portion of the second terminal and the second flat plate portion of the second terminal are sequentially arranged from front to rear in the longitudinal column direction.

In certain embodiments, the two adjacent ones of the terminals forming the differential signal pair comprise a first terminal and a second terminal; the first flat plate portion of the first terminal, the main body portion of the first terminal, the first flat plate portion of the second terminal and the main body portion of the second terminal are sequentially arranged from left to right; and the first terminal and the second terminal are not in a same one of the transverse rows.

Compared with the related art, certain embodiments of the present invention have the following beneficial effects:

The electrical connector of the present invention is provided with multiple shielding members. Each shielding member is accommodated in the body and is located at one side of one terminal. One terminal and one shielding member form one shielding assembly. Each shielding member is arranged between the two adjacent terminals in two adjacent shielding assemblies. One end of each shielding member is configured to be electrically connected to the chip module, and another end is configured to be electrically connected to the circuit board. Since each shielding member is provided at one side of each terminal, the anti-interference capability of each terminal is enhanced. Moreover, two adjacent terminals form a differential signal pair, and one shielding member is arranged between the two adjacent differential signal pairs, such that the signal interference between the two adjacent differential signal pairs can be decreased, thus ensuring the stability of the signal transmission of the electrical connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
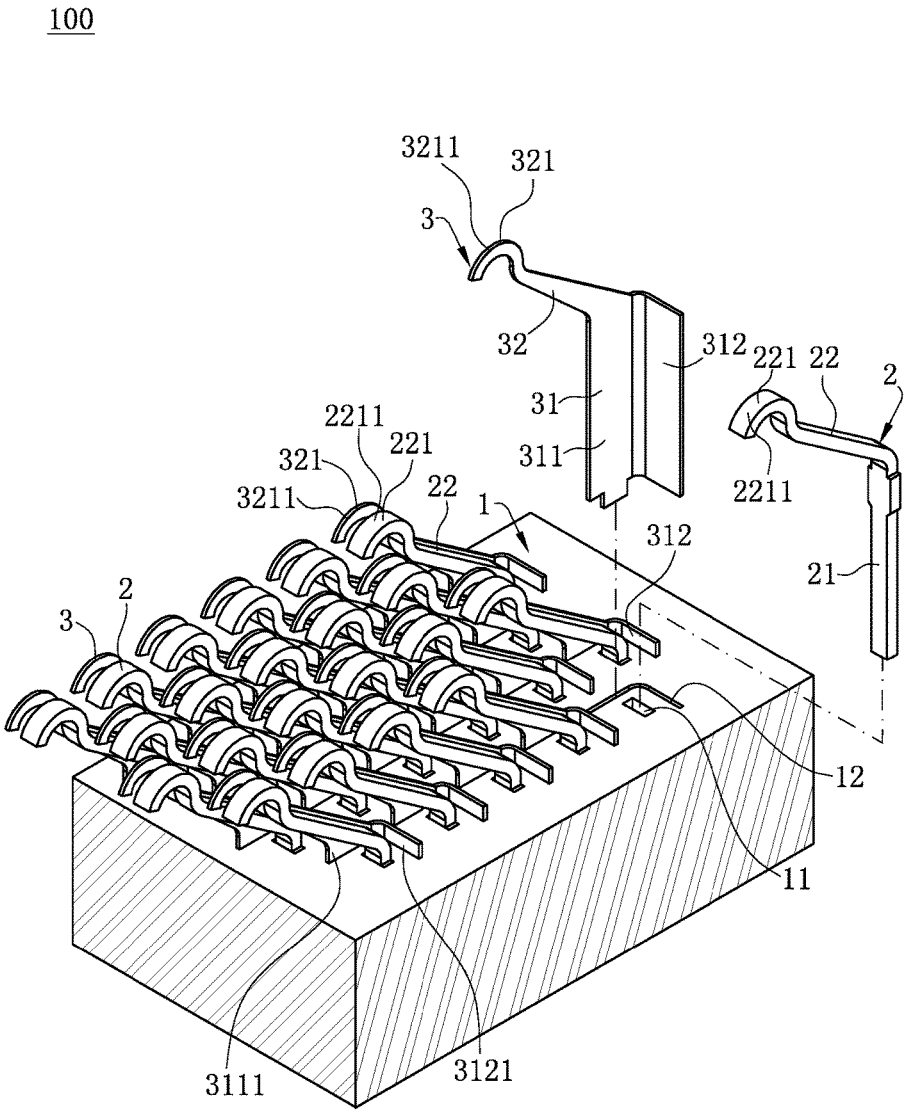
FIG. 1 is a perspective exploded view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-9. In accordance with the purposes of this invention, as embodied and broadly described herein, this invention, in one aspect, relates to an electrical connector.

Figure 4:
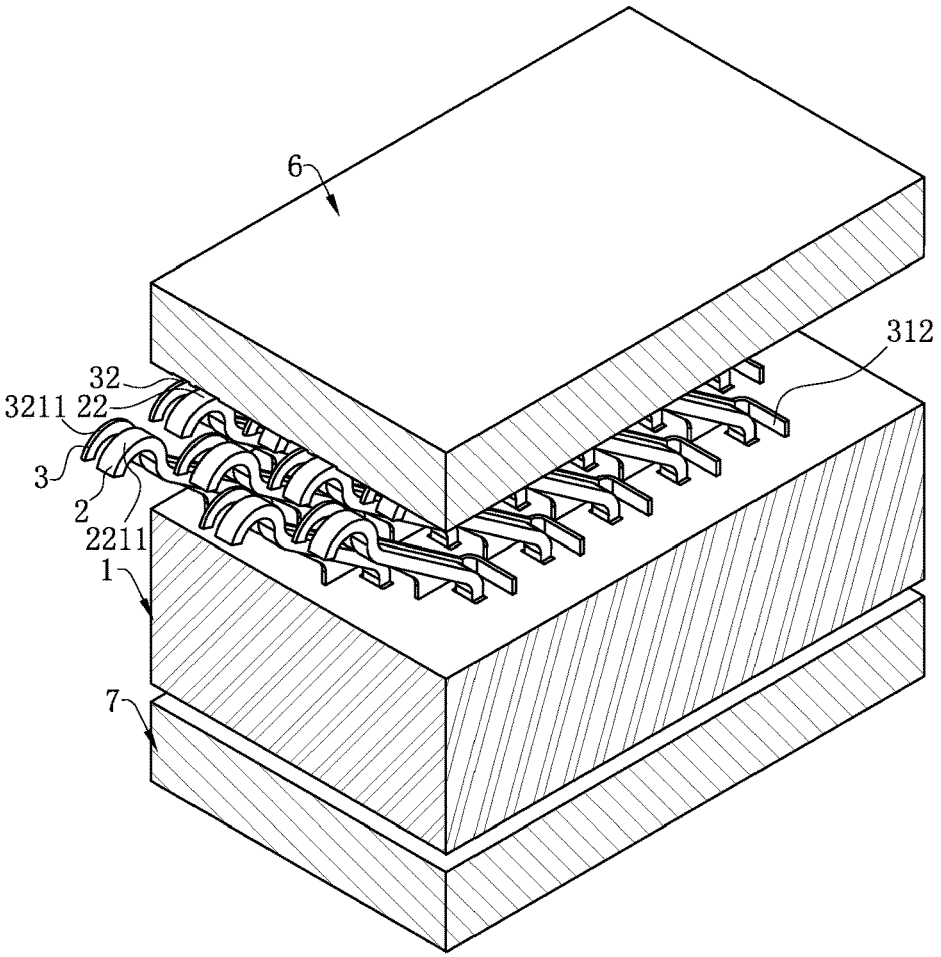
FIG. 4 is a perspective assembly view of the electrical connector according to the first embodiment of the present invention from another viewing angle.

As shown in FIG. 4, an electrical connector 100 according to a first embodiment of the present invention, which is configured to electrically connect a chip module 6 with a circuit board 7, includes a body 1, multiple terminals 2, and multiple shielding members 3 accommodated in the body 1.

Figure 2:
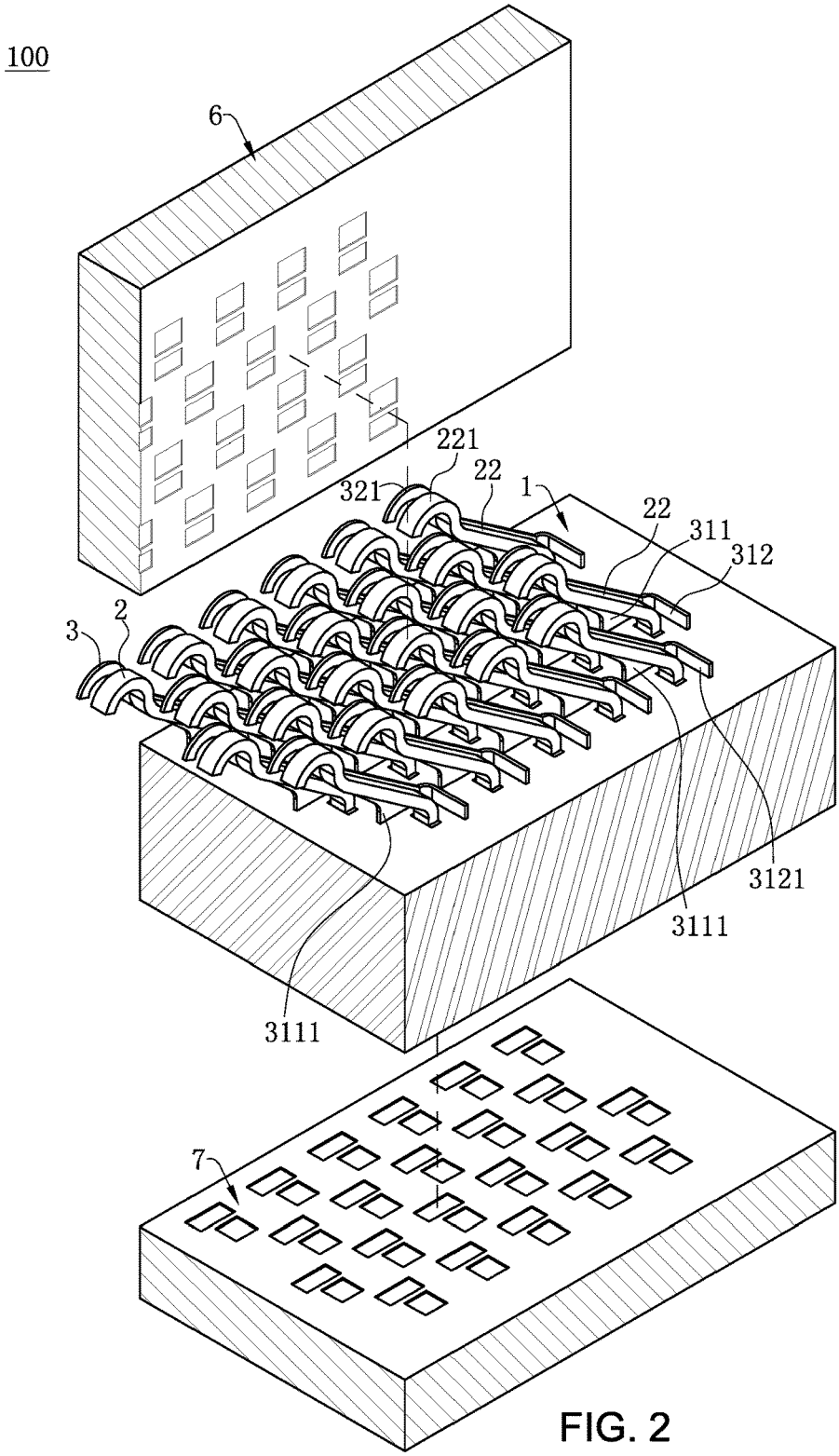
FIG. 2 is a perspective assembly view of the electrical connector according to the first embodiment of the present invention.

As shown in FIG. 2, the chip module 6 and the circuit board 7 respectively have multiple signal solder pads (not labeled) and multiple ground solder pads (not labeled).

As shown in FIG. 1, the body 1 has multiple first accommodating slots 11 and multiple second accommodating slots 12.

Figure 3:
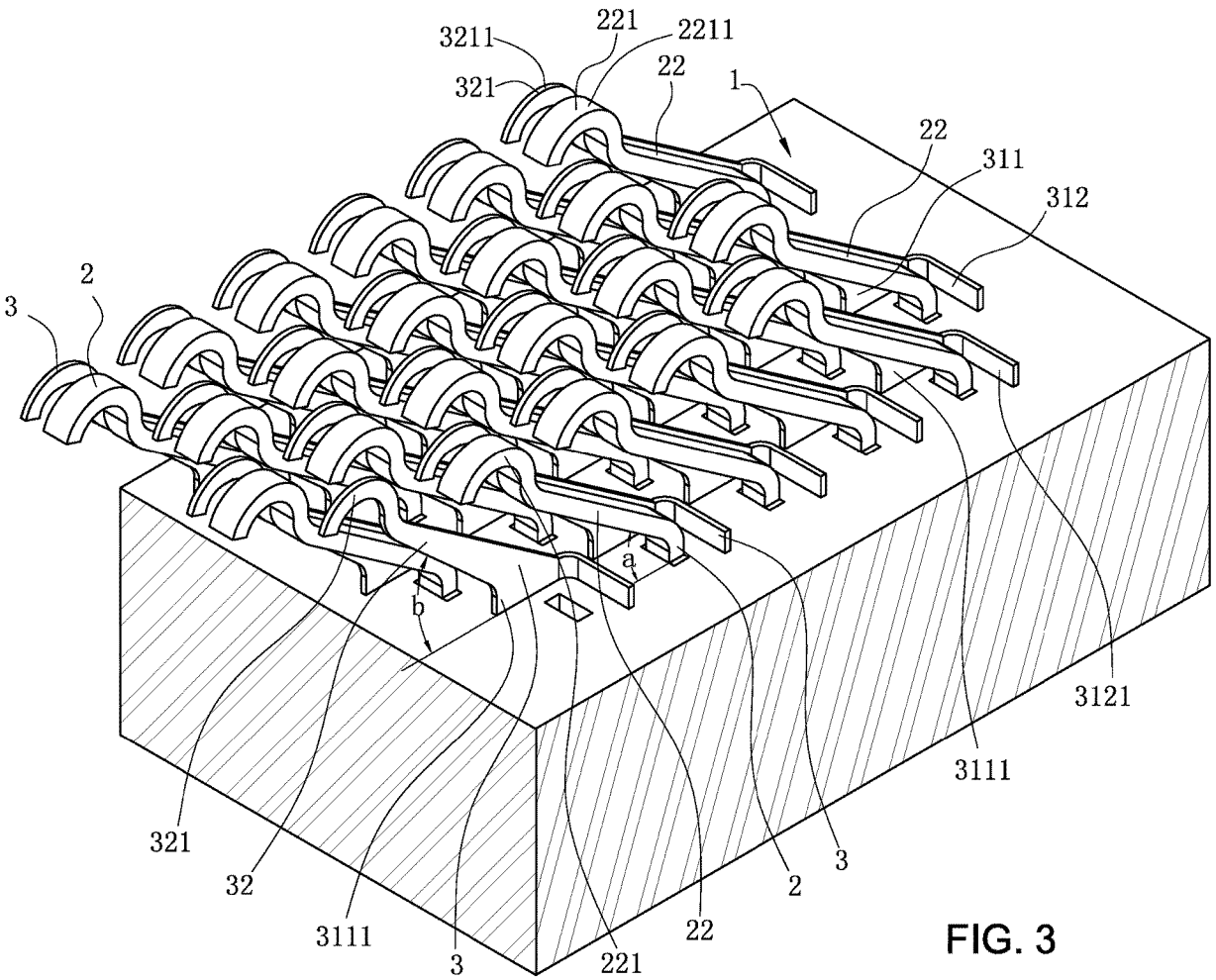
FIG. 3 is a partial schematic view of FIG. 2.
Figure 5:
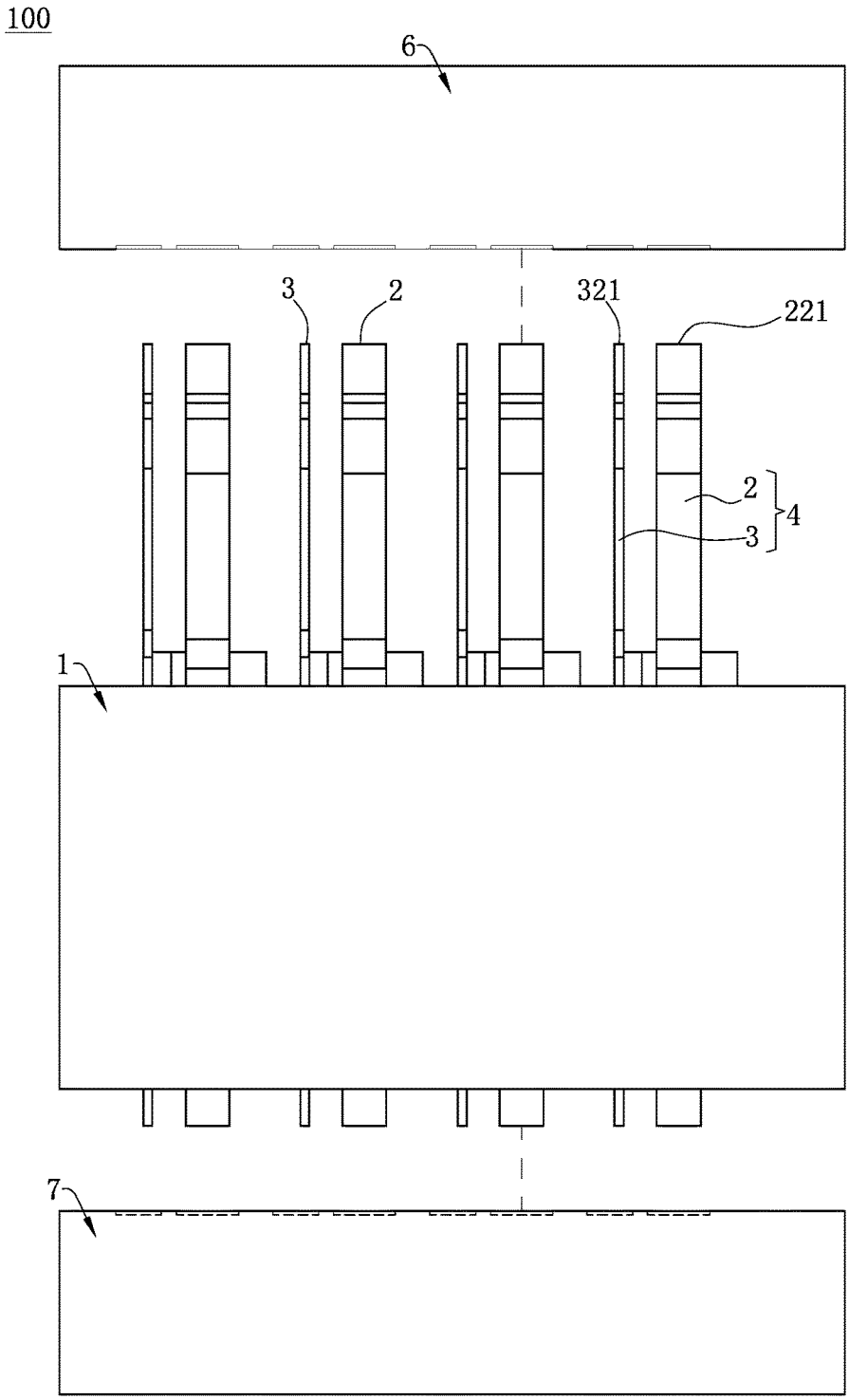
FIG. 5 is a front view of the electrical connector according to the first embodiment of the present invention.
Figure 6:
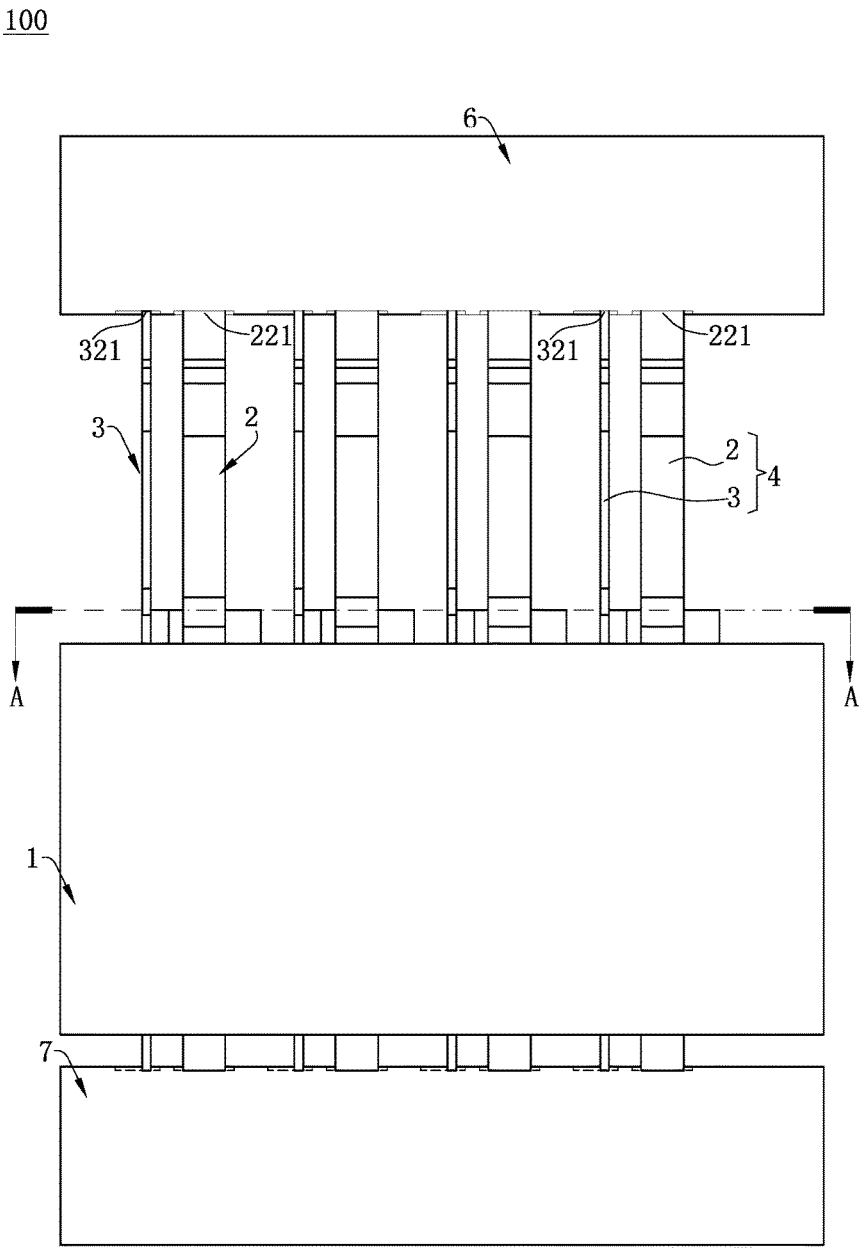
FIG. 6 is a front view of the electrical connector in another state according to the first embodiment of the present invention.

As shown in FIG. 1, FIG. 2 and FIG. 3, the terminals 2 are respectively accommodated in the first accommodating slots 11. Each terminal 2 has a main body portion 21 which is vertical. A first extending arm 22 bends upward and extends from one end of the main body portion 21. An angle a (as shown in FIG. 3) is formed between the first extending arm 22 and the body 1. One end of the first extending arm 22 which is away from the main body portion 21 has a first contact portion 221 which is curve shaped, and the first contact portion 221 is configured to upward abut the chip module 6, and in particular, to abut the signal solder pad (as shown in FIG. 5 and FIG. 6). The first contact portion 221 has a plate surface 2211, which is in contact with the chip module 6. A contact method between the first contact portion 221 and the chip module 6 is plate surface contact. Another end of the main body portion 21 is configured to downward abut the circuit board 7, and in particular, to abut the signal solder pad.

As shown in FIG. 1, FIG. 2 and FIG. 3, a second extending arm 32 extends obliquely upward from the first exposed portion 3111. An angle b (as shown in FIG. 3) is formed between the second extending arm 32 and the body 1, and the angle a is equal to the angle b. One end of the second extending arm 32 which is away from the first exposed portion 3111 has a second contact portion 321 which is curve shaped. The second contact portion 321 is configured to upward abut the chip module 6 (as shown in FIG. 5 and FIG. 6). The second contact portion 221 has a blanking surface 3211, which is in contact with the chip module 6. The first contact portion 221 and the second contact portion 321 are on a same height level, and the first flat plate portion 311, the second extending arm 32 and the second contact portion 321 are located on the same plane. Moreover, a contact method between the second contact portion 321 and the chip module 6 is blanked surface contact, such that a force by the chip module 6 pressing downward on the second extending arm 32 is greater than a force by the chip module 6 pressing downward on the first extending arm 22. Another end of the first flat plate portion 311 is configured to downward abut the circuit board 7. The second exposed portion 3121 is configured to be connected to a strip (not shown).

Figure 7:
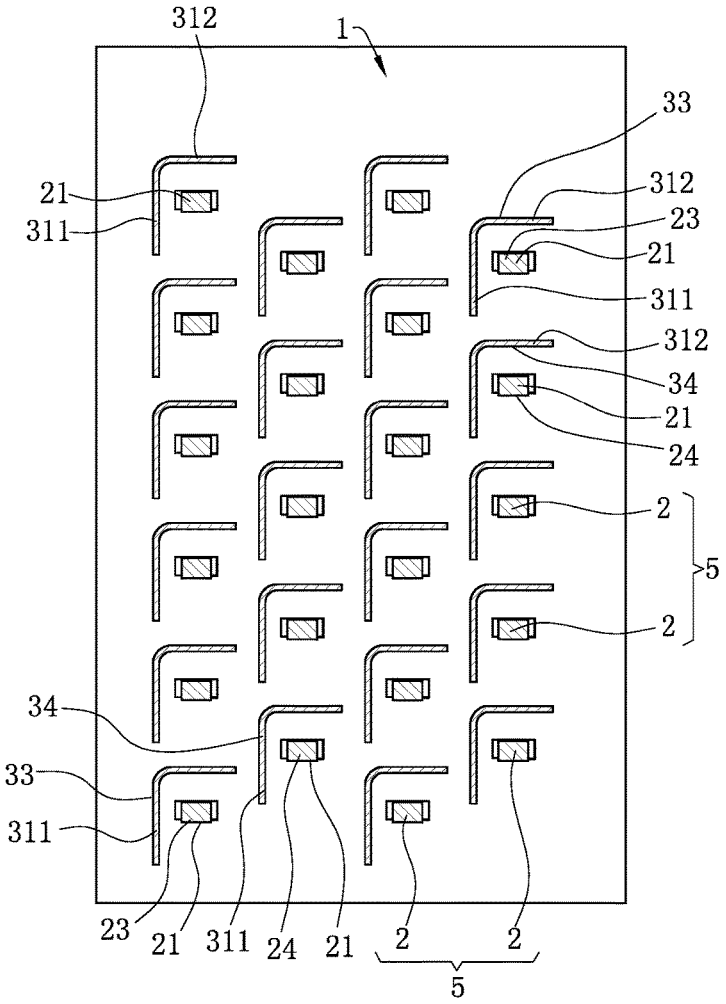
FIG. 7 is a sectional view of the electrical connector according to the first embodiment of the present invention along line A-A.

As shown in FIG. 1 and FIG. 7, two adjacent terminals 2 form a differential signal pair 5, and one terminal 2 and one shielding member 3 form a shielding assembly 4. At least one shielding portion 31 is arranged between each two adjacent shielding assemblies 4. The shielding assemblies 4 are staggeredly provided on the body 1, and specifically, the shielding assemblies 4 are respectively transversely arranged from left to right in multiple transverse rows, and are longitudinally arranged from front to rear in multiple longitudinal columns. Specifically, the two adjacent terminals 2 that form each differential signal pair 5 may include a first terminal 23 and a second terminal 24. Further, a first shielding member 33 is provided to correspond to the first terminal 23 such that the first terminal 23 and the first shielding member 33 form a first shielding assembly, and a second shielding member 34 is provided to correspond to the second terminal 24 such that the second terminal 24 and the second shielding member 34 form a second shielding assembly. For each differential signal pair 5 in a longitudinal column direction, the two terminals 2 (i.e., the first terminal 23 and the second terminal 24) forming the differential signal pair 5 are arranged along the longitudinal column direction, and the main body portion 21 of the first terminal 23, the second flat plate portion 312 of the shielding portion of the first shielding member 33, the main body portion 21 of the second terminal 24 and the second flat plate portion 312 of the shielding portion of the second shielding member 34 are sequentially arranged from front to rear. For each differential signal pair 5 not in the longitudinal column direction, the first flat plate portion 311 of the shielding portion of the first shielding member 33, the main body portion 21 of the first terminal 23, the first flat plate portion 311 of the shielding portion of the second shielding member 34 and the main body portion 21 of the second terminal 24 are sequentially arranged from left to right, and the two terminals 2 (i.e., the first terminal 23 and the second terminal 24) forming the differential signal pair 5 not in the longitudinal column direction are not in the same transverse row.

As shown in FIG. 1 and FIG. 5, the first contact portion 221 and the second contact portion 321 are on the same height level, and the angle a is equal to the angle b. When the chip module 6 presses downward toward the body 1 (as shown in FIG. 5), the first extending arm 22 and the second extending arm 32 are deformed to be simultaneously obliquely downward toward the body 1. As the force by the chip module 6 pressing on the second extending arm 32 is greater than the force by the chip module 6 pressing on the first extending arm 22, the second extending arm 32 upward support the chip module 6. Meanwhile, the terminals 2 are prevented from being excessively pressed to deform. In another embodiment, one end of the main body portion 21 which is away from the first extending arm 22, as well as one end of the first flat plate portion 311 which is away from the second extending arm 32, may also be provided as elastic arms (not shown), and the elastic arms are configured to abut the circuit board 7.

Figure 8:
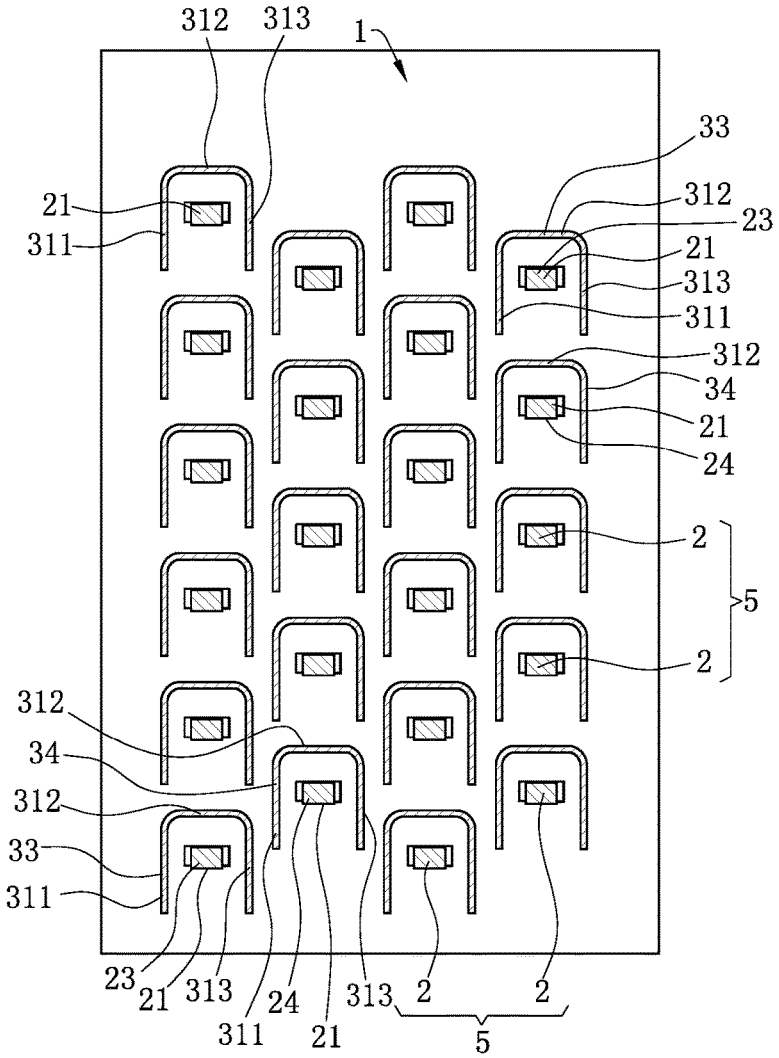
FIG. 8 is a partial sectional view of an electrical connector of according to a second embodiment of the present invention.

FIG. 8 shows a second embodiment of the present invention. The differences of this embodiment from the first embodiment exist in that: a third flat plate portion 313 bends and extends from one side of the second flat plate portion 312 which is away from the first flat plate portion 311. The third flat plate portion 313 is parallel to the first flat plate portion 311, and the first flat plate portion 311, the second flat plate portion 312 and the third flat plate portion 313 are located at three sides of the main body portion 21. For each differential signal pair 5 in the longitudinal column direction, the two terminals 2 (i.e., the first terminal 23 and the second terminal 24) forming the differential signal pair 5 are arranged along the longitudinal column direction, and the main body portion 21 of the first terminal 23, the second flat plate portion 312 of the shielding portion of the first shielding member 33, the main body portion 21 of the second terminal 24 and the second flat plate portion 312 of the shielding portion of the second shielding member 34 are sequentially arranged from front to rear. The two adjacent differential signal pairs 5 in a front-rear direction are partitioned by the second flat plate portion 312, and the second flat plate portion 312 decreases the signal interference between the two adjacent differential signal pairs 5 in the front-rear direction, ensuring the stability of the high-speed signal transmission of the electrical connector 100. For each differential signal pair 5 not in the longitudinal column direction, the first flat plate portion 311 of the shielding portion of the first shielding member 33, the main body portion 21 of the first terminal 23, the third flat plate portion 313 of the shielding portion of the first shielding member 33, the first flat plate portion 311 of the shielding portion of the second shielding member 34, the main body portion 21 of the second terminal 24 and the third flat plate portion 313 of the shielding portion of the second shielding member 34 are sequentially arranged from left to right, and the two terminals 2 (i.e., the first terminal 23 and the second terminal 24) forming the differential signal pair 5 not in the longitudinal column direction are not in the same transverse row. The two differential signal pairs 5 not in the longitudinal column direction are partitioned by the first flat plate portion 311 of the shielding portion of the second shielding member 34 and the third flat plate portion 313 of the shielding portion of the first shielding member 33, and the first flat plate portion 311 of the shielding portion of the second shielding member 34 and the third flat plate portion 313 of the shielding portion of the first shielding member 33 decrease the signal interference between the two adjacent differential signal pairs 5 not in the longitudinal column direction, ensuring the stability of the high-speed signal transmission of the electrical connector 100.

Figure 9:
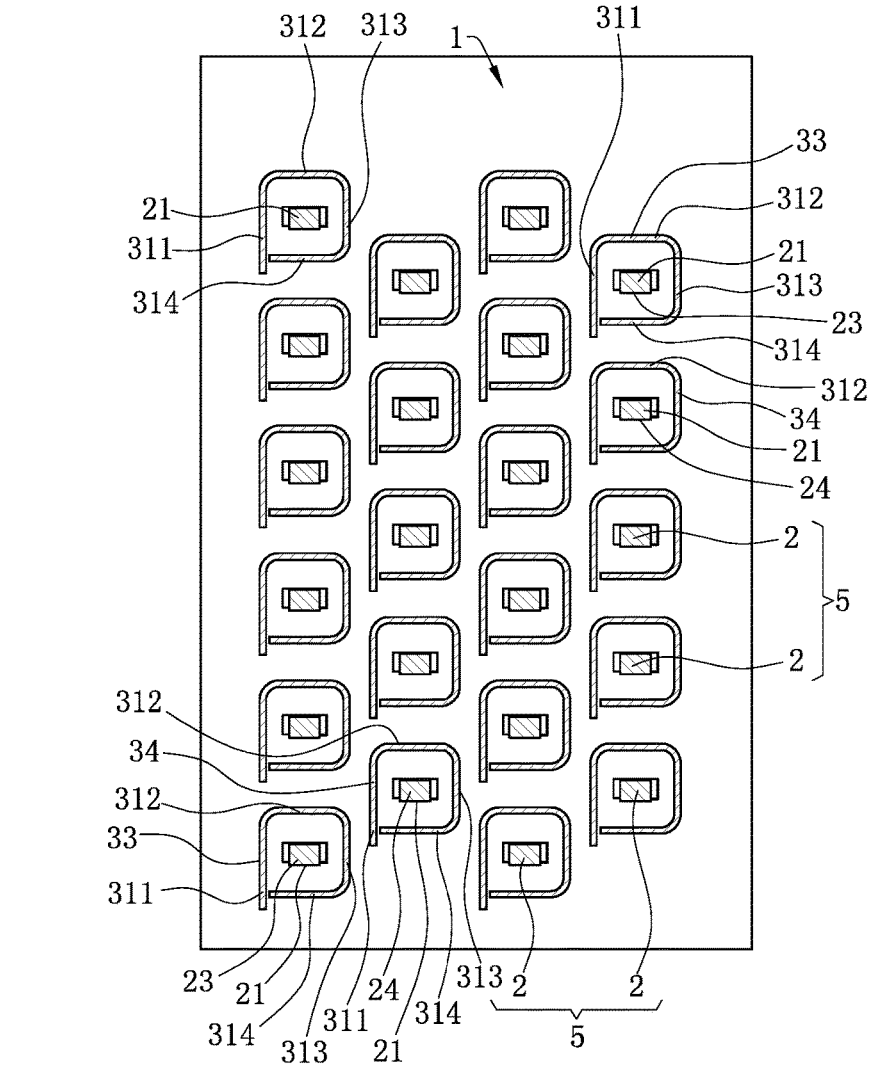
FIG. 9 is a partial sectional view of an electrical connector according to a third embodiment of the present invention.

FIG. 9 shows a third embodiment of the present invention. The differences of this embodiment from the first embodiment and the second embodiment exist in that: the third flat plate portion 313 bends and extends from one side of the second flat plate portion 312 which is away from the first flat plate portion 311. The third flat plate portion 313 is parallel to the first flat plate portion 311. A fourth flat plate portion 314 bends and extends from one end of the third flat plate portion 313 which is away from the second flat plate portion 312. The first flat plate portion 311, the second flat plate portion 312, the third flat plate portion 313 and the fourth flat plate portion 314 are provided around the main body portion 21. For each differential signal pair 5 in the longitudinal column direction, the two terminals 2 (i.e., the first terminal 23 and the second terminal 24) forming the differential signal pair 5 are arranged along the longitudinal column direction, and the fourth flat plate portion 314 of the shielding portion of the first shielding member 33, the main body portion 21 of the first terminal, the second flat plate portion 312 of the shielding portion of the first shielding member 33, the fourth flat plate portion 314 of the shielding portion of the second shielding member 34, the main body portion 21 of the second terminal 24 and the second flat plate portion 312 of the shielding portion of the second shielding member 34 are sequentially arranged from front to rear. The two adjacent differential signal pairs 5 in the front-rear direction are partitioned by the second flat plate portion 312 and the fourth flat plate portion 314, and the second flat plate portion 312 and the fourth flat plate portion 314 decrease the signal interference between the two adjacent differential signal pairs 5 in the front-rear direction, ensuring the stability of the high-speed signal transmission of the electrical connector 100. For each differential signal pair 5 not in the longitudinal column direction, the first flat plate portion 311 of the shielding portion of the first shielding member 33, the main body portion 21 of the first terminal 23, the third flat plate portion 313 of the shielding portion of the first shielding member 33, the first flat plate portion 311 of the shielding portion of the second shielding member 34, the main body portion 21 of the second terminal 24 and the third flat plate portion 313 of the shielding portion of the second shielding member 34 are sequentially arranged from left to right, and the two terminals 2 (i.e., the first terminal 23 and the second terminal 24) forming the differential signal pair 5 not in the longitudinal column direction are not in the same transverse row. The two differential signal pairs 5 not in the longitudinal column direction are partitioned by the first flat plate portion 311 of the shielding portion of the second shielding member 34 and the third flat plate portion 313 of the shielding portion of the first shielding member 33, and the first flat plate portion 311 of the shielding portion of the second shielding member 34 and the third flat plate portion 313 of the shielding portion of the first shielding member 33 decrease the signal interference between each two adjacent differential signal pairs 5 not in the longitudinal column direction, ensuring the stability of the high-speed signal transmission of the electrical connector 100.

To sum up, the electrical connector 100 according to certain embodiments of the present invention has the following beneficial effects:

(1) The electrical connector 100 of the present invention is provided with multiple shielding members 3. Each shielding member 3 is accommodated in the body 1 and is located at one side of one terminal 2. One terminal 2 and one shielding member 3 form one shielding assembly 4. Each shielding member 3 is arranged between the two adjacent terminals 2 in two adjacent shielding assemblies 4. One end of each shielding member 3 is configured to be electrically connected to the chip module 6, and another end is configured to be electrically connected to the circuit board 7. Since each shielding member 3 is provided at one side of each terminal 2, the anti-interference capability of each terminal 2 is enhanced. Moreover, two adjacent terminals 2 form a differential signal pair 5, and one shielding member 3 is arranged between the two adjacent differential signal pairs 5, such that the signal interference between the two adjacent differential signal pairs 5 can be decreased, thus ensuring the stability of the signal transmission of the electrical connector 100.

(2) The first contact portion 221 and the second contact portion 321 are on the same height level, and the angle a is equal to the angle b. When the chip module 6 presses downward toward the body 1 (as shown in FIG. 5), the first extending arm 22 and the second extending arm 32 are deformed to be simultaneously obliquely downward toward the body 1. As the force by the chip module 6 pressing on the second extending arm 32 is greater than the force by the chip module 6 pressing on the first extending arm 22, the second extending arm 32 upward support the chip module 6. Meanwhile, the terminals 2 are prevented from being excessively pressed to deform.

(3) For each differential signal pair 5 in the longitudinal column direction, the two terminals 2 (i.e., the first terminal and the second terminal) forming the differential signal pair 5 are arranged along the longitudinal column direction, and the main body portion 21 of the first terminal, the second flat plate portion 312 of the first terminal, the main body portion 21 of the second terminal and the second flat plate portion 312 of the second terminal are sequentially arranged from front to rear. The two adjacent differential signal pairs 5 in a front-rear direction are partitioned by the second flat plate portion 312, and the second flat plate portion 312 decreases the signal interference between the two adjacent differential signal pairs 5 in the front-rear direction, ensuring the stability of the high-speed signal transmission of the electrical connector 100.

(4) For each differential signal pair 5 not in the longitudinal column direction, the first flat plate portion 311 of the first terminal, the main body portion 21 of the first terminal, the third flat plate portion 313 of the first terminal, the first flat plate portion 311 of the second terminal, the main body portion 21 of the second terminal and the third flat plate portion 313 of the second terminal are sequentially arranged from left to right, and the two terminals 2 (i.e., the first terminal and the second terminal) forming the differential signal pair 5 not in the longitudinal column direction are not in the same transverse row. The two differential signal pairs 5 not in the longitudinal column direction are partitioned by the first flat plate portion 311 and the third flat plate portion 313, and the first flat plate portion 311 and the third flat plate portion 313 decrease the signal interference between the two adjacent differential signal pairs 5 not in the longitudinal column direction, ensuring the stability of the high-speed signal transmission of the electrical connector 100.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to electrically connect a chip module to a circuit board, comprising:

a body;

a plurality of terminals, respectively accommodated in the body, wherein each of the terminals has one end configured to be electrically connected to the chip module and another end configured to be electrically connected to the circuit board, and two adjacent ones of the terminals form a differential signal pair; and a plurality of shielding members, wherein each of the shielding members is accommodated in the body and located at one side of a corresponding one of the terminals, and each of the shielding members has one end configured to be electrically connected to the chip module and another end configured to be electrically connected to the circuit board, wherein the terminals and the shielding members correspondingly form a plurality of shielding assemblies, such that each of the shielding assemblies comprises one of the terminals and one of the shielding members, and in each of two adjacent ones of the shielding assemblies, at least one of the shielding members is provided between two adjacent ones of the terminals in the two adjacent ones of the shielding assemblies, wherein each of the terminals has a main body portion, a first extending arm bends and extends from one end of the main body portion, the first extending arm is configured to abut the chip module, and another end of the main body portion is configured to abut the circuit board;

wherein each of the shielding members has a shielding portion located at one side of the main body portion, a second extending arm extends from one end of the shielding portion, the second extending arm is configured to abut the chip module, and another end of the shielding portion is configured to abut the circuit board;

wherein the shielding portion comprises a first flat plate portion and a second flat plate portion, one end of the first flat plate portion extends obliquely upward to form the second extending arm, the second extending arm and the first flat plate portion are on a same plane, the second extending arm is configured to abut the chip module, and another end of the first flat plate portion is configured to abut the circuit board.

2. The electrical connector according to claim 1, wherein:

the one end of the main body portion bends upward and extends to form the first extending arm, the first extending arm has a first contact portion being curve shaped, the first contact portion is configured to upward abut the chip module, and the another end of the main body portion is configured to downward abut the circuit board; and the second extending arm extends obliquely upward from the one end of the shielding portion, the second extending arm has a second contact portion being curve shaped, the second contact portion is configured to upward abut the chip module, and the another end of the shielding portion is configured to downward abut the circuit board.

3. The electrical connector according to claim 2, wherein the second contact portion, the second extending arm and the shielding portion are on a same plane.

4. The electrical connector according to claim 1, wherein an angle a is formed between the first extending arm and the body, an angle b is formed between the second extending arm and the body, and the angle a is equal to the angle b.

5. The electrical connector according to claim 4, wherein when the chip module is pressed downward toward the body, the first extending arm and the second extending arm are deformed to be obliquely downward toward the body, and a force by the chip module pressing on the second extending arm is greater than a force by the chip module is pressed on the first extending arm.

6. The electrical connector according to claim 1, wherein the second flat plate portion is formed by bending and extending from one side of the first flat plate portion, the first flat plate portion and the second flat plate portion are perpendicular to each other, and the first flat plate portion and the second flat plate portion are located at two sides of the main body portion.

7. The electrical connector according to claim 6, wherein a third flat plate portion bends and extends from the second flat plate portion, the third flat plate portion is parallel to the first flat plate portion, and the first flat plate portion, the second flat plate portion and the third flat plate portion are respectively located at three sides of the main body portion.

8. The electrical connector according to claim 7, wherein a fourth flat plate portion is formed by bending and extending from the third flat plate portion, the fourth flat plate portion is parallel to the second flat plate portion, and the first flat plate portion, the second flat plate portion, the third flat plate portion and the fourth flat plate portion are arranged around a periphery of the main body portion.

9. The electrical connector according to claim 6, wherein the shielding assemblies are staggeredly distributed on the body, and the shielding assemblies are respectively transversely arranged from left to right in a plurality of transverse rows, and are longitudinally arranged from front to rear in a plurality of longitudinal columns.

10. The electrical connector according to claim 9, wherein the two adjacent ones of the terminals forming the differential signal pair comprise a first terminal and a second terminal along a longitudinal column direction, the first terminal and a first shielding member of the shielding members form a first shielding assembly of the shielding assemblies, the second terminal and a second shielding member of the shielding members form a second shielding assembly of the shielding assemblies, and the main body portion of the first terminal, the second flat plate portion of the shielding portion of the first shielding member, the main body portion of the second terminal and the second flat plate portion of the shielding portion of the second shielding member are sequentially arranged from front to rear in the longitudinal column direction.

11. The electrical connector according to claim 9, wherein:

the two adjacent ones of the terminals forming the differential signal pair comprise a first terminal and a second terminal, the first terminal and a first shielding member of the shielding members form a first shielding assembly of the shielding assemblies, and the second terminal and a second shielding member of the shielding members form a second shielding assembly of the shielding assemblies;

the first flat plate portion of the shielding portion of the first shielding member, the main body portion of the first terminal, the first flat plate portion of the shielding portion of the second shielding member and the main body portion of the second terminal are sequentially arranged from left to right; and the first terminal and the second terminal are not in a same one of the transverse rows.

12. The electrical connector according to claim 2, wherein the second contact portion has a blanking surface in contact with the chip module, and the first contact portion has a plate surface in contact with the chip module.

13. The electrical connector according to claim 2, wherein the first contact portion and the second contact portion are on a same height level.

14. An electrical connector, configured to electrically connect a chip module to a circuit board, comprising:

a body;

a plurality of terminals, respectively accommodated in the body, wherein each of the terminals has one end configured to be electrically connected to the chip module and another end configured to be electrically connected to the circuit board, and two adjacent ones of the terminals form a differential signal pair; and a plurality of shielding members, wherein each of the shielding members is accommodated in the body and located at one side of a corresponding one of the terminals, and each of the shielding members has one end configured to be electrically connected to the chip module and another end configured to be electrically connected to the circuit board, wherein the terminals and the shielding members correspondingly form a plurality of shielding assemblies, such that each of the shielding assemblies comprises one of the terminals and one of the shielding members;

wherein each of the terminals has a main body portion, one end of the main body portion bends upward and extends to form a first extending arm, the first extending arm has a first contact portion, the first contact portion is configured to upward abut the chip module, and another end of the main body portion is configured to downward abut the circuit board;

wherein each of the shielding members has a shielding portion located at one side of the main body portion, a second extending arm extends obliquely upward from one end of the shielding portion, the second extending arm has a second contact portion, the second contact portion is configured to upward abut the chip module, and another end of the shielding portion is configured to downward abut the circuit board; and wherein the second contact portion, the second extending arm and the shielding portion are on a same plane.

15. The electrical connector according to claim 14, wherein the first contact portion has a plate surface in contact with the chip module, the second contact portion has a blanking surface in contact with the chip module, and the first contact portion and the second contact portion are on a same height level.

16. The electrical connector according to claim 14, wherein an angle a is formed between the first extending arm and the body, an angle b is formed between the second extending arm and the body, and the angle a is equal to the angle b.

17. The electrical connector according to claim 16, wherein when the chip module is pressed downward toward the body, the first extending arm and the second extending arm are deformed to be obliquely downward toward the body, and a force by the chip module pressing on the second extending arm is greater than a force by the chip module is pressed on the first extending arm.

18. An electrical connector, configured to electrically connect a chip module to a circuit board, comprising:

a body;

a plurality of terminals, respectively accommodated in the body, wherein each of the terminals has one end configured to be electrically connected to the chip module and another end configured to be electrically connected to the circuit board, and two adjacent ones of the terminals form a differential signal pair; and a plurality of shielding members, wherein each of the shielding members is accommodated in the body and located at one side of a corresponding one of the terminals, and each of the shielding members has one end configured to be electrically connected to the chip module and another end configured to be electrically connected to the circuit board, wherein the terminals and the shielding members correspondingly form a plurality of shielding assemblies, such that each of the shielding assemblies comprises one of the terminals and one of the shielding members;

wherein each of the terminals has a main body portion, a first extending arm bends and extends from one end of the main body portion, the first extending arm is configured to abut the chip module, and another end of the main body portion is configured to abut the circuit board;

wherein each of the shielding members has a shielding portion located at one side of the main body portion, a second extending arm extends from one end of the shielding portion, the second extending arm is configured to abut the chip module, and another end of the shielding portion is configured to abut the circuit board; and wherein the shielding portion comprises a first flat plate portion and a second flat plate portion, one end of the first flat plate portion extends obliquely upward to form the second extending arm, the second extending arm and the first flat plate portion are on a same plane, the second extending arm is configured to abut the chip module, and another end of the first flat plate portion is configured to abut the circuit board.

19. The electrical connector according to claim 18, wherein the second flat plate portion is formed by bending and extending from one side of the first flat plate portion, the first flat plate portion and the second flat plate portion are perpendicular to each other, and the first flat plate portion and the second flat plate portion are located at two sides of the main body portion.

20. The electrical connector according to claim 19, wherein:

the shielding assemblies are staggeredly distributed on the body, and the shielding assemblies are respectively transversely arranged from left to right in a plurality of transverse rows, and are longitudinally arranged from front to rear in a plurality of longitudinal columns;

the two adjacent ones of the terminals forming the differential signal pair comprise a first terminal and a second terminal, the first terminal and a first shielding member of the shielding members form a first shielding assembly of the shielding assemblies, the second terminal and a second shielding member of the shielding members form a second shielding assembly of the shielding assemblies, the first flat plate portion of the shielding portion of the first shielding member, the main body portion of the first terminal, the first flat plate portion of the shielding portion of the second shielding member and the main body portion of the second terminal are sequentially arranged from left to right, and the first terminal and the second terminal are not in a same one of the transverse rows.

* * * * *